United States Patent [19]

Murray et al.

[11] Patent Number: 4,867,374

[45] Date of Patent: Sep. 19, 1989

[54] PAPERBOARD DRINKING CUP

[75] Inventors: Lowell C. Murray; Frederick Wyss, both of Fort Wayne, Ind.

[73] Assignee: Container Corporation of America, Clayton, Mo.

[21] Appl. No.: 242,321

[22] Filed: Sep. 8, 1988

[51] Int. Cl.[4] ..... B65D 5/36; B65D 5/18

[52] U.S. Cl. ..... 229/110; 229/1.5 B; 229/104; 229/193; 229/117.06; 229/192; 229/190

[58] Field of Search ..... 229/110, 1.5 B, 48 SA, 229/ 48 R

[56] References Cited

U.S. PATENT DOCUMENTS

| | | | |
|---|---|---|---|
| 1,025,937 | 5/1912 | Vargyas et al. | 229/1.5 B |
| 1,351,412 | 8/1920 | Carr | 229/1.5 B |
| 1,478,838 | 12/1923 | Reifsnyder | 229/1.5 B |
| 1,690,586 | 11/1928 | Main | 229/1.5 B |
| 1,738,782 | 12/1929 | Main | 229/1.5 B |
| 2,323,287 | 7/1943 | Amberg | 229/1.5 B |
| 3,317,118 | 5/1967 | Harrison et al. | 229/110 |
| 3,726,469 | 4/1973 | Koehler | 229/110 |
| 4,020,988 | 5/1977 | Kipp | 229/1.5 B |
| 4,094,457 | 6/1978 | Spillson | 229/1.5 B |
| 4,227,640 | 8/1980 | Roccaforte | 229/110 |

*Primary Examiner*—Stephen Marcus
*Assistant Examiner*—Jes F. Pascua
*Attorney, Agent, or Firm*—Richard W. Carpenter

[57] ABSTRACT

A collapsible, self-standing, liquid resistant, drinking cup formed from a unitary blank of uncoated paperboard and having a bottom wall member and a pair of side wall members that are interconnected at their side edges and that have certain lower edges joined to the bottom wall member and other lower edges disposed below the bottom wall member to support the erected cup on a horizontal surface.

8 Claims, 1 Drawing Sheet

PAPERBOARD DRINKING CUP

BACKGROUND OF THE INVENTION

1. Field of the Invention

This invention relates to paperboard drinking cups, and more particularly to a collapsible, self-standing, drinking cup formed from uncoated paperboard.

2. Description of the Background Art

A background art search directed to the subject matter of this application conducted in the U.S. Patent and Trademark Office disclosed the the following U.S. Letters Patent:

| | | | |
|---|---|---|---|
| 1,180,330 | 1,555,054 | 2,232,088 | 2,508,962 |
| 2.936,940 | 2,966,293 | 3,630,430 | 3,726,469 |
| 3,845,897 | 3,877,632 | 4,020,988 | 4,094,457 |
| 4,164,588 | 4,185,764 | 4.200,219 | 4,267,955 |
| 4,360,146 | 4,410,129 | 4,470,540 | |

None of the patents uncovered in the search discloses a collapsible, self-standing, liquid resistant, drinking cup formed, from a one piece blank of uncoated paperboard, which has has a bottom wall member and a pair of side wall members that are interconnected at their side edges and that have certain lower edges joined to the bottom wall members and other lower edges disposed below the bottom wall member to support the erected cup from a horizontal surface.

SUMMARY OF THE INVENTION

It is an object of the invention to provide a collapsible drinking cup, formed from a blank of plain uncoated paperboard, which will hold liquid for a limited period of time and which is completely self-standing.

A more specific object of the invention is the provision of a self-standing drinking cup that includes a bottom wall member and a pair of side wall members interconnected at their side edges and having certain lower edges joined to the bottom wall member and certain other lower edges disposed below the bottom wall member to support the erected cup on a horizontal surface.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
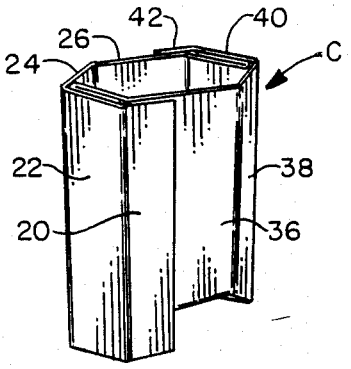
FIG. 1 is a perspective view of a drinking cup embodying features of the invention, as shown in the erected and standing position.
Figure 2:
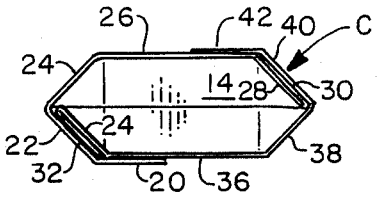
FIG. 2 is a fragmentary top plan view of the structure illustrated in FIG. 1.
Figure 4:
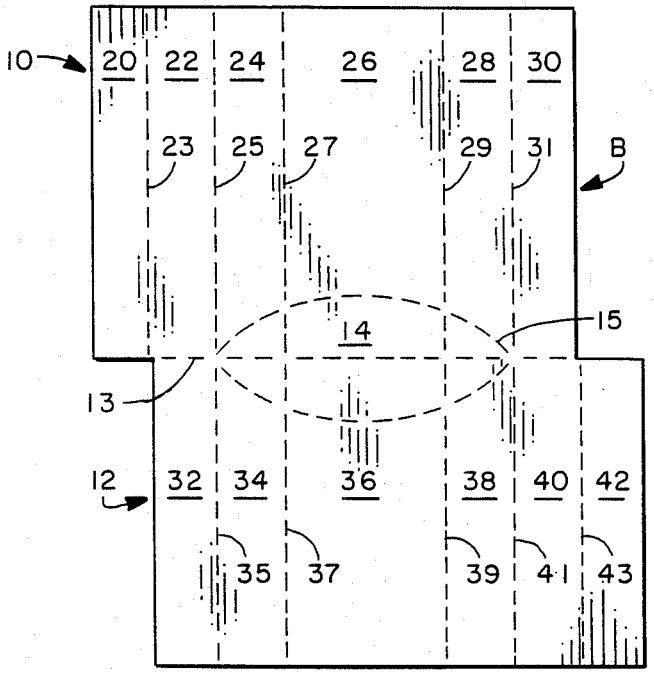
FIG. 4 is a plan view of a blank of foldable sheet material from which the cup illustrated in the other views may be formed.

Referring now to the drawings for a better understanding of the invention, it will be seen that the collapsible, self-standing drinking cup indicated generally at C in FIG. 1 of the drawings may be formed from a unitary blank B of foldable sheet material illustrated in FIG. 4. The sheet material in the case of the present invention can be plain uncoated paperboard, preferrably 10 point, low density, solid bleached sulphate paperboard. Thus, the carton is far less expensive to produce than cartons formed from plastic coated paperboard or other more expensive materials.

As best seen in FIG. 4, the blank B of paperboard from which the cup C is formed includes a pair of generally similar side wall members 10 and 12, respectively, which are joined to each other along a common transverse fold line 13.

A bottom wall member 14 is formed from material of the two side wall members by means of a pair of preferably curved, opposed score lines 15 which extend from fold line 13 across portions of each of the side wall members 10 and 12.

Each of these side wall members includes a centrally located main panel which is flanked by a pair of major and minor side panel sections.

Still referring to FIG. 4, it will be seen that first side wall member 10 includes: a major side panel section outboard panel 20, a major side panel section center panel 22, a major side panel section inboard panel 24, a main panel 26, a minor side panel section inboard panel 28, and a minor side panel section outboard panel 30, which are foldably joined to each other along parallel fold lines 23, 25, 27, 29, and 31, respectively.

In a similar manner, second side wall member 12 includes: minor side panel section outboard panel 32, minor side panel section inboard panel 34, main panel 36, major side panel section inboard panel 38, major side panel section center panel 40, and major side panel section outboard panel 42, which are foldably joined to each other along parallel fold lines 35, 37, 39, 41, and 43, respectively.

As previously mentioned, first and second side wall members 10 and 12 are foldably connected to each other by a common, transversely extending fold line 13. It will be noted, however, that the side wall members are placed in offset, end-to-end relation and in reverse position, so that the major side panel section of each side wall member is aligned with the minor side panel section of the other side wall member.

Also, as previously memtioned, the bottom wall member of the cup, indicated generally at 14, is defined by the score lines 15 which are preferably bowed away from each other and which extend across lower portions of each side wall member main panel and the panels immediately adjacent each main panel.

Figure 5:
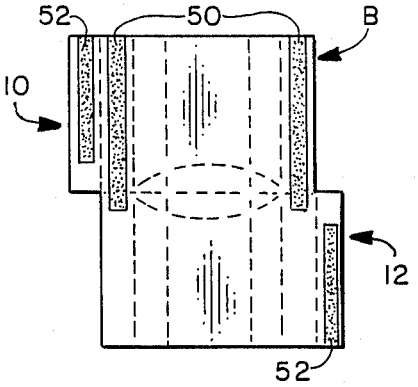
FIGS. 5 and 6 are views similar to that of FIG. 4 and illustrate the folding sequence by which the cup illustrated in FIG. 1 is formed from the blank illustrated in FIG. 4.

Turning now to FIG. 5, it will be seen that a glue pattern 50 is applied to the major side panel section center panel and the minor side panel section outboard panel of one side wall member 10. This glue pattern also extends across score line 13 into the adjacent panel of the other side wall member 12. A second glue pattern 52 is applied to portions of the major side panel section outboard panel 20 of the first side wall member 10 and the major side wall section outboard panel 42 of the other side wall member 12.

Figure 6:
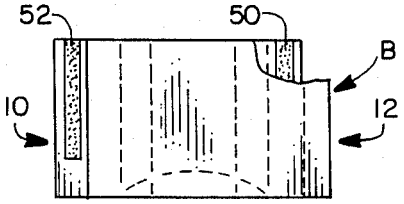

In order to form cup C from blank B, second side wall member 12 is folded 180 degrees to overlie first side wall member 10, as illustrated in FIG. 6. Because of the offset between side wall members 10 and 12, panel 20 of member 10 and panel 42 of member 12 extend beyond the common portions of the two members that overlie each other.

Figure 7:
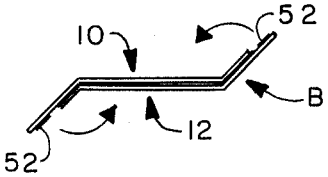
FIG. 7 is a fragmentary top plan view of the structure illustrated in FIGS. 5 and 6 and shows the folding sequence required in the formation of the cup.

Next, panels 20 and 22 of member 10, together with panel 32 of member 12, are folded 180 degrees about a common score line 25/35 and secured to the central portion of one side of the blank. At the same time panels 40 and 42 of member 12, together with panel 31 of member 10, are folded 180 degrees about the common score line 31/41 and secured to the central portion of the other side of the blank, as illustrated in FIG. 7.

Figure 3:
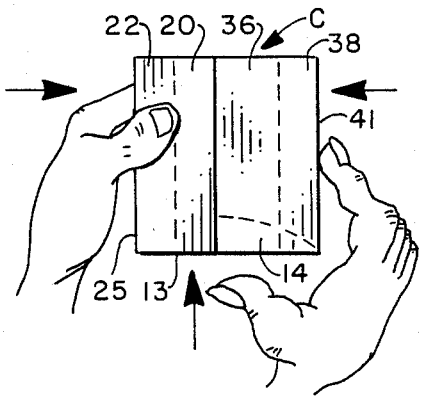
FIG. 3 is a side elevational view of the structure illustrated in FIG. 1.

In order to open the cup, bottom wall member 14 is pushed upwardly, as illustrated in FIG. 3, and the cup is automatically erected and ready to accept liquid and be self-standing as illustrated in FIG. 1.

Thus, it will be appreciated that the invention provides a unique, collapsible, self-standing, drinking cup which may be formed from an economical blank of uncoated paperboard.

What is claimed is:

1. A collapsible, liquid resistant, drinking cup formed from a unitary blank of sheet material, such as paperboard, comprising:

(a) a bottom wall member;

(b) a pair of first and second side wall members having certain lower edges foldably joined to opposed side edges of said bottom wall member;

(c) said side wall members having central portions spaced from each other and having side portions joined to each other to form with said bottom wall member a liquid receiving cavity;

(d) each of said side wall members including a main panel and a pair of side panel sections foldably joined to opposite side edges of said main panel;

(e) said side panel sections each including at least two adjacent panels foldably joined to each other;

(f) at least one panel of the side panel section of one side wall member being reverse folded to lie against an adjacent panel of its section;

(g) at least one side panel section of the other side wall member being folded around and adhesively secured to said one panel and the main panel of the other side wall member;

(h) said bottom wall member being formed entirely from material of said side wall members and being defined by a pair of curved opposed score lines each of which extends across a main panel and the panels immediately adjacent the main panel of each side wall member.

2. A carton according to claim 1, wherein said side wall members have other lower edges disposed below a substantial area of said bottom wall member to support said cup on a horizontal surface.

3. A carton according to claim 1, wherein one of said side panel sections is a major section and the other side panel section is a minor section.

4. A carton according to claim 3, wherein said major section includes an inboard panel, a center panel, and an outboard panel and wherein said minor section includes an outboard panel and an related inboard panel.

5. A carton according to claim 4, wherein the minor side panel section outboard panel of each side wall member is reverse folded to lie against its related inboard panel.

6. A carton according to claim 4, wherein the major side panel section center and outboard panels of each side wall member are folded around and adhesively secured to the minor side panel section outboard panel and the main panel, respectively, of the other side wall member.

7. A blank of foldable sheet material, such as paperboard, for use in forming a collapsible, self-standing, liquid resistant, drinking cup, said blank being cut and scored to provide:

(a) a pair of identical side wall members each including a main panel and major and minor side panel sections foldably joined to opposite side edges of said main panel;

(b) said major side panel section including an inboard panel, a center panel, and an outboard panel;

(c) said minor side panel section including an inboard panel and an outboard panel;

(d) said side wall members being foldably joined to each other along a transverse score line in offset end-to-end relation with the outboard panel of the minor panel section of each member aligned with the center panel of the major side panel section of the other member;

(e) a pair of curved opposed score lines having corresponding ends meeting at said transverse score line at locations beyond opposite sides of the main panels of said members and being spaced from each intermediate their ends to define therebetween a bottom wall member formed from material of said side wall members;

(f) said opposed score lines extending across the main panel and the panels immediately adjacent the main panel of each side wall member.

8. A blank according to claim 7, wherein said opposed score lines are arcuate and are bowed away from each other.

* * * * *